United States Patent [19]

Fantuzzo et al.

[11] Patent Number: 4,630,919

[45] Date of Patent: Dec. 23, 1986

[54] SELECTABLE COLOR SYSTEM

[75] Inventors: Joseph Fantuzzo, Webster; Edwin R. Monkelbaan, Fairport, both of N.Y.

[73] Assignee: Xerox Corporation, Stamford, Conn.

[21] Appl. No.: 757,552

[22] Filed: Jul. 22, 1985

[51] Int. Cl.[4] ..... G03G 15/00

[52] U.S. Cl. ..... 355/4; 355/3 BE; 355/16

[58] Field of Search ..... 355/4, 3 BE, 16, 3 DD, 355/10; 118/645; 346/157

[56] References Cited

U.S. PATENT DOCUMENTS

| | | | |
|---|---|---|---|
| 3,084,043 | 4/1963 | Gundlach | 96/1 |
| 3,658,407 | 4/1972 | Kitano et al. | 350/96 B |
| 3,806,354 | 4/1974 | Amidon et al. | 117/37 LE |
| 3,947,106 | 3/1976 | Hamaguchi et al. | 355/1 |
| 3,977,777 | 8/1976 | Tanaka et al. | 355/1 |
| 3,998,184 | 12/1976 | Hudson | 118/658 |
| 4,097,139 | 6/1978 | Hauser et al. | 355/4 |
| 4,176,940 | 12/1979 | Katakabe et al. | 355/10 |
| 4,251,154 | 2/1981 | Russel | 355/4 |
| 4,279,496 | 7/1981 | Silverberg | 355/3 BE |

*Primary Examiner*—Arthur T. Grimley
*Assistant Examiner*—J. Pendegrass

[57] ABSTRACT

A printing apparatus comprising a flexible photoreceptor belt movable past a series of image processing stations, and driven around at least two support rollers, has a developer module having at least two alternately selectable stationary developer housings positioned within the run of the photoreceptor belt between the support rolls together with an articulating backup blade to alternately urge the photoreceptor belt into development engagement with one of the stationary developer housings to develop an electrostatic latent image formed on the belt.

6 Claims, 2 Drawing Figures

SELECTABLE COLOR SYSTEM

BACKGROUND OF THE INVENTION

The present invention relates generally to electrostatographic printing machines for reproducing an original document on a copy sheet. In particularly, the printing machine of the present invention includes a developer module with at least two developer housings and means to alternately urge the photoreceptor belt into development engagement with one of the developer housing to develop the electrostatic latent image.

Generally, in the process of electrostatographic printing a photoconducting member is charged with substantially uniform potential to sensitize the surface thereof. The charged portion of the photoconductive surface is exposed to a light image of an original document being reproduced. This records an electrostatic latent image on the photoconductive member corresponding to the informational areas contained within the original document. After recording the electrostatic latent image on the photoconductive member, the latent image is developed by bringing a developer material comprising carrier granules having toner particles adhering triboelectrically thereto into contact therewith. The toner particles are attracted from the carrier granules to the electrostatic latent image to form a toner powder image which is subsequently transferred to a copy sheet and permanently affixed thereto in image configuration by pressure or heat. Alternatively, the electrostatic latent image may be developed with a liquid developer by loading, for example, a patterned, developer applicator roll having raised portions and recessed portions with liquid developer and bringing the applicator roll into contact with the photoreceptor so that the charge on the photoreceptor induces a charge in the liquid developer and pulls the liquid developer off the applicator roll in image configuration. This technique is described, for example, in U.S. Pat. No. 3,084,043 and U.S. Pat. No. 3,806,354.

Generally, each electrostatographic printing machine is provided with a single developer housing which produces a developed image of the color of the developer material included within the developer housing. Alternatively however, such as in the Xerox 6500 multi-color electrophotographic printing machine, a series of electrostatic latent images corresponding to a single color of the original document are produced. Successive partial color light images are employed to record each of the single color latent images. Each single color electrostatic latent image is developed with toner particles of a color complimentary to the color of the light image to form a subtractive system. Such a multi-color development system utilizes a plurality of developer rolls, each being adapted to furnish the appropriate color toner particles to the photoconductive member. The successive electrostatic latent images are developed with different color toner particles to produce a multi-color reproduction.

There is frequently a desire on the part of the user of such electrostatographic reproducing machines to provide the capability to copy documents in more than one color. Alternatively it is also desired by the users to provide portions of a reproduced document in one color and other portions, such as for highlight purposes, in a second color.

PRIOR ART

U.S. Pat. No. 3,998,184 (Hudson)—illustrates a multicolor development apparatus wherein individual developer units may be moved into and out of developing engagement with a stationary cylindrical photoreceptor drum.

U.S. Pat. No. 4,097,139 (Hauser et al.)—describes a reproducing machine having interchangable developer housings which contain different colored marking particles to enable the user to develop one latent image with particles of one color and another latent image with particles of a second color.

U.S. Pat. No. 4,176,940 (Katakabe et al)—discloses a color photocopier with movable developer units which contact an electrophotographic film. In FIG. 4, developer units 29*c*, 29*m* and 29*y* can be selectably positioned under film 1 by movement of processing table 26.

U.S. Pat. No. 4,279,496 (Silverberg)—describes a belt support system wherein the belt is supported by a fixed mounting and a movable mounting wherein during operation of the belt, the movable mounting deflects the planar portion of the belt to the operative position. To remove the belt, the movable mounting is returned to the inoperative position to facilitate removal from the fixed mounting.

SUMMARY OF THE INVENTION

In accordance with the principal aspect of the present invention there is provided a printing machine comprising a flexible photoreceptor belt movable past a series of image processing stations, the belt being driven around at least two support rolls, together with means to form an electrostatic latent image on the belt, and means to develop the electrostatic latent image with a marking material comprising a developer module having at least two alternately selectable stationary developer housing positioned within the run of the photoreceptor between the support rolls and means to alternately urge that photoreceptor belt into development engagement with one of the stationary developer housing to develop the electrostatic latent image on the belt together with means to transfer the developed image to a receiving surface such as copy paper.

In a further aspect of the present invention a dual position articulating backup blade in the interior of the run of the photoreceptor belt is provided, two ends of which are alternately engagable with the belt to provide developing engagement with one of the developer housings.

In a further aspect of the present invention, the dual position articulating backup blade may be manually, alternately articulated between positions to provide development engagement with one of the developer housings.

In a further aspect of the present invention, the separate developer housings in the developer module may be provided with different colored developer material.

In a further aspect of the present invention, the developer module further includes means to clean the photoreceptor belt in advance of the first developer housing in the developer module.

In a further aspect of the present invention, each developer housing includes a rotatable developer applicator roll for supplying developer to the electrostatic latent image when in development engagement with the belt.

It is an object of the present invention to provide an alternately, selectable color development system that provides selectable color in a printing apparatus.

It is a further object of the present invention to provide a compact, reliable, low cost, simple technique for providing selectable, single color development of electrostatic latent image or two color, two paths, highlight color copies.

BRIEF DESCRIPTION OF THE PREFERRED EMBODIMENT

Figure 1:
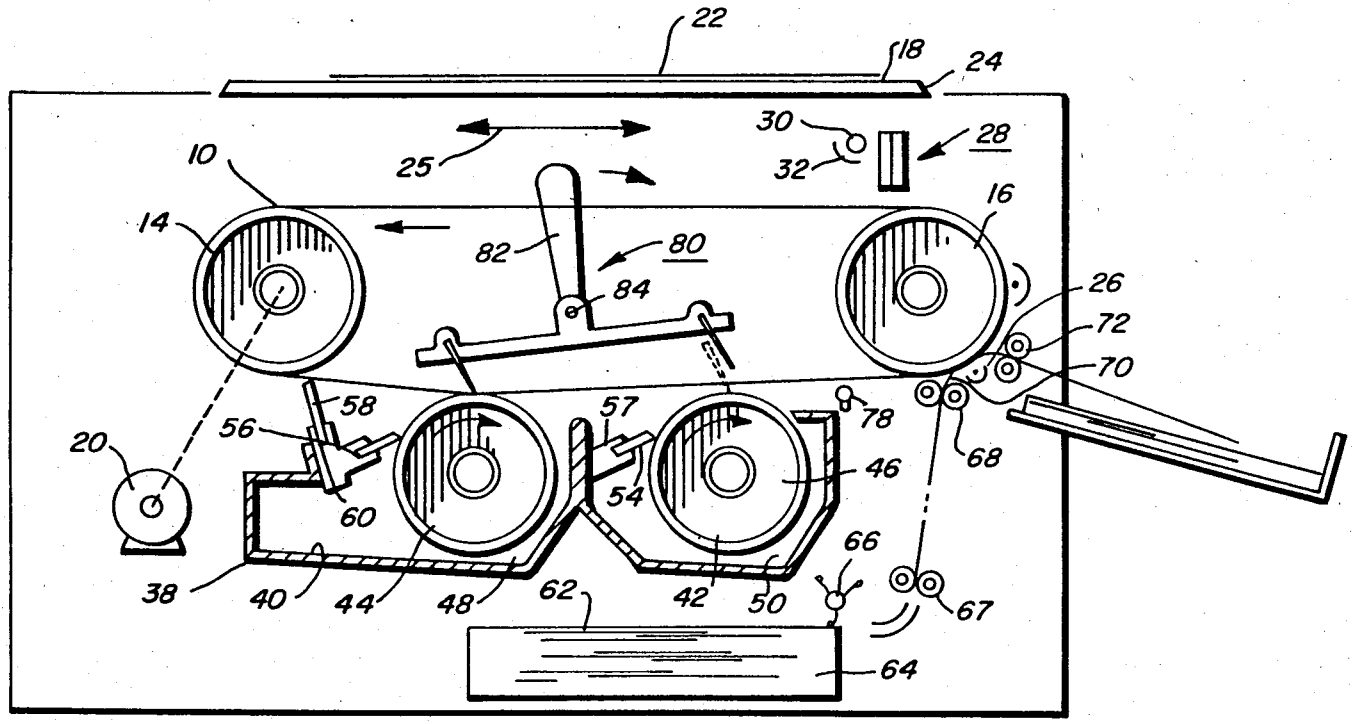
FIG. 1 is a schematic representation in cross-section of an automatic electrostatographic printing machine with the selectable color system according to the present invention.

The invention will now be described with reference to a preferred embodiment of the printing apparatus with a selectable color feature according to the present invention.

The drawings schematically depict the various components of electrostatographic reproducing machine incorporating the features of the present invention therein. In the drawings and specification like reference numerals have been used throughout the designate identical elements. It will become evident from the following discussion that these features are equally suited for use in a wide variety of electrostatographic reproducing machines and are not necessarily limited in their application to particular embodiments depicted herein.

Referring now to FIG. 1, as shown in the drawing, the electrophotographic printing machine employs a belt 10 having a photoconductive surface deposited on a conductive substrate. Preferably, the photoconductive surface is made from an organic photoconductor with the conductive substrate being made from an aluminum alloy. Belt 10 moves in the direction of arrow 12 to advance successive portions of the photoconductive surface through the various processing stations disposed about the path of movement thereof. Rollers 14 and 16 maintain belt 10 under suitable tension. Roller 16 is mounted in suitable bearings to rotate freely and act as an idler roller. Motor 20 drives roller 14 to advance belt 10 in the direction of arrow 12.

An original document 22 is disposed facedown upon a transparent platen 18 which is mounted in the frame capable of reciprocating motion in a horizontal direction, as indicated by arrow 25. Belt 10 is driven at a linear velocity synchronized to the linear velocity of the platen 18. Belt 10 moves in a recirculating path. In order to reproduce a copy of an original document 22, belt 10 performs two complete cycles of movement through the recirculating path.

During the first cycle, belt 10 advances a portion of the photoconductive surface initially adjacent to a charging transfer unit indicated generally by the reference numeral 26. Charging-transferring unit 26 includes a corona generating device which charges the photoconductive surface of belt 10 to a relatively high substantially uniform potential.

Next, belt 10 advances the charged portion of the photoconductive surface beneath a combined exposing-discharging unit, indicated generally by the reference numeral 28. Combined exposing-discharging unit 28 includes a light source 30, preferably an elongated tungsten lamp disposed stationarily beneath the platen 18. An opaque shield 32 surrounds light source 30 so that the light rays from light source 30 are projected onto original document 22 disposed facedown on transparent platen 18. As platen 18 moves in the direction of arrow 25, successive incremental portions of original document 22 are illuminated. Light rays reflected from the original document 22 are transmitted through a bundle of image transmitting fibers, indicated generally by the reference numeral 42. Image transmitting fibers 42 are bundled gradient index optical fibers. U.S. Pat. No. 3,658,407 issued to Kitano et al. in 1972, describes a light conducting fiber made of glass or synthetic resin which has a refractive index distribution in cross-section thereof that varies consecutively and parabolically outwardly from a center portion thereof. Each fiber acts as a focusing lens to transmit part of an image placed at, or near, one end thereof. An assembly of fibers staggered two-row array, transmits and focuses a complete image of the object. The fiber lenses are produced under the tradename "SELFOC" registered in Japan, and owned by Nippon Sheet Glass Company, Limited. These gradient index lens arrays are used as a replacement for conventional optical systems in electrophotographic printing machines, such being disclosed in U.S. Pat. No. 3,947,106 issued to Hamaguchi et al., in 1976 and U.S. Pat. No. 3,977,777 issued to Tanaka et al. in 1976. The light rays reflected from the original document are transmitted through the image transmitting fibers onto the charged portions of the photoconductive surface of belt 10 to selectively dissipate the charge thereon. This records an electrtostatic latent image on the photoconductive surface of belt 10 which corresponds to the informational areas contained within original document 22.

Thereafter, the belt 10 advances the electrostatic latent image recorded on the photoconductive surface to developer station comprising a developer module 38 which includes at least two developer housings 40 and 42, each of which contains a rotatably mounted developer roll 44 and 46 rotating in developer sumps 48 and 50. In the particular embodiment illustrated in FIG. 1 the developer rolls have a patterned surface applicator which may be used to provide a supply of liquid developer according to the technique of U.S. Pat. No. 3,084,043 in the grooves of the pattern adjacent to the charged image on the photoconductor for development of the image thereon. Each of the developer rolls 44 and 46 is provided with metering blades 52 and 54 to meter the amount of liquid developer present in the recessed portions of the developer applicator and to clean the raised or land surfaces of the applicator which come in contact with the photoreceptor surface. The metering blades are held in contact with the developer rolls by means of metering blade supports 56 and 57. Also present in the first developer housing and at the upstream portion thereof is a cleaning blade 58 which during the development cycle may be pivoted about pivot point 60 out of contact with the photoreceptor belt. As the photoreceptor belt is transported through the development zone, liquid developer is attracted to the electrostatic latent image in image configuration onto the photoreceptor belt providing a developed image of the electrostatic latent image thereon.

While the above described development system is described with reference to liquid developer, it should be noted that other development mechanisms such as magnetic brush development may be used. Typically in such a system, a developer roll comprising a rotatably mounted elongated cylindrical sleeve, having an elongated magnet stationarily mounted interiorly of the sleeve will bring developer particles including ferro magnetic material in a resin binder into development engagement with the photoreceptor belt.

Returning once again to FIG. 1, after the developed image is formed on the photoconductive surface of belt 10, the belt 10 passes through combined charged transfer unit 26 with the start of the second cycle. At this time a copy sheet 62 is advanced by a sheet feeder 66 to combined charging transfer unit 28. The copy sheet is advanced in a timed sequence so as to be in synchronism with the developed image formed on the photoconductive surface of belt 10. In this way, one side of the copy sheet contacts the developed image on the photoreceptor at combined charging transfer unit 26. Preferably the sheet feeder includes a rotatably mounted cylinder having a plurality of spaced flexible vanes extending upwardly therefrom. The free end of each vane successively engages the uppermost sheet 62 of the stack. As the feeder 66 rotates sheet 62 moves into the sheet transport roll pair 67. Registration rollers 68 advance the sheet 62 through chute 70 in synchronism with the developed image on the photoconductive surface of belt 10 to combined charging transfer unit 26.

The corona generating device of combined charging transfer unit 26 sprays ions onto the backside of the copy sheet which attracts the developed image from the photoconductive surface of belt 10 to the sheet. After transfer, the sheet continues to move with the belt until the beam strength thereof causes it to strip therefrom as belt 10 passes around roller 16. As the sheet separates from the belt it advances to exit roller 72 finally into copy sheet catch tray 74.

In the above described embodiment no developer image fixing station has been provided since the development technique described therein does not require that the image be fused. If alternative dry development techniques are employed, it may be desirable to provide a fuser assembly adjacent to the transfer station to permanently affix the toner powder image to the copy sheet.

Following transfer of the developer image from the photoconductive belt, the belt advances in the direction of arrow 12 past the exposure station 28 and around drive roll 14. The surface of the photoconductive belt 10 is cleaned of any residual liquid developer by means of contact with cleaner blade 58 which is now pivoted into engagement with the belt 10 by being pivoted about its pivot point 60. Cleaning blade 58 is in wiping contact with the surface of photoconductive belt 10 to scrape or remove any residual liquid developer on the surface of the belt which may fall and be collected in used developer sump 76.

After any remaining developer has been cleaned from the photoconductive surface of the belt 10, the residual charge thereon may be neutralized by exposure to discharge lamp 78. Subsequently the two-cycle imaging process may commence once again with uniform charging of the photoreceptor at combined charge transfer unit 26, exposure at exposure unit 28, development at developer module 38, transfer during the second cycle at combined charge transfer unit 26, followed by cleaning by cleaning blade 58 and uniform discharge of the belt by means of lamp 78.

Normally, when the copier is operated in a conventional mode the original document to be reproduced is placed image side down upon a horizontal transport viewing platen which transports the original past the optical arrangement here illustrated as a "SELFOC" lens. The speed of the moving platen and the speed of the photoconductive belt are synchronized to provide a faithful reproduction of the original document.

It is believed that the foregoing general description is sufficient for the purposes of the present application to illustrate the general operation of an electrostatographic printing machine which can embody a selectable color feature according to the present invention.

Figure 2:
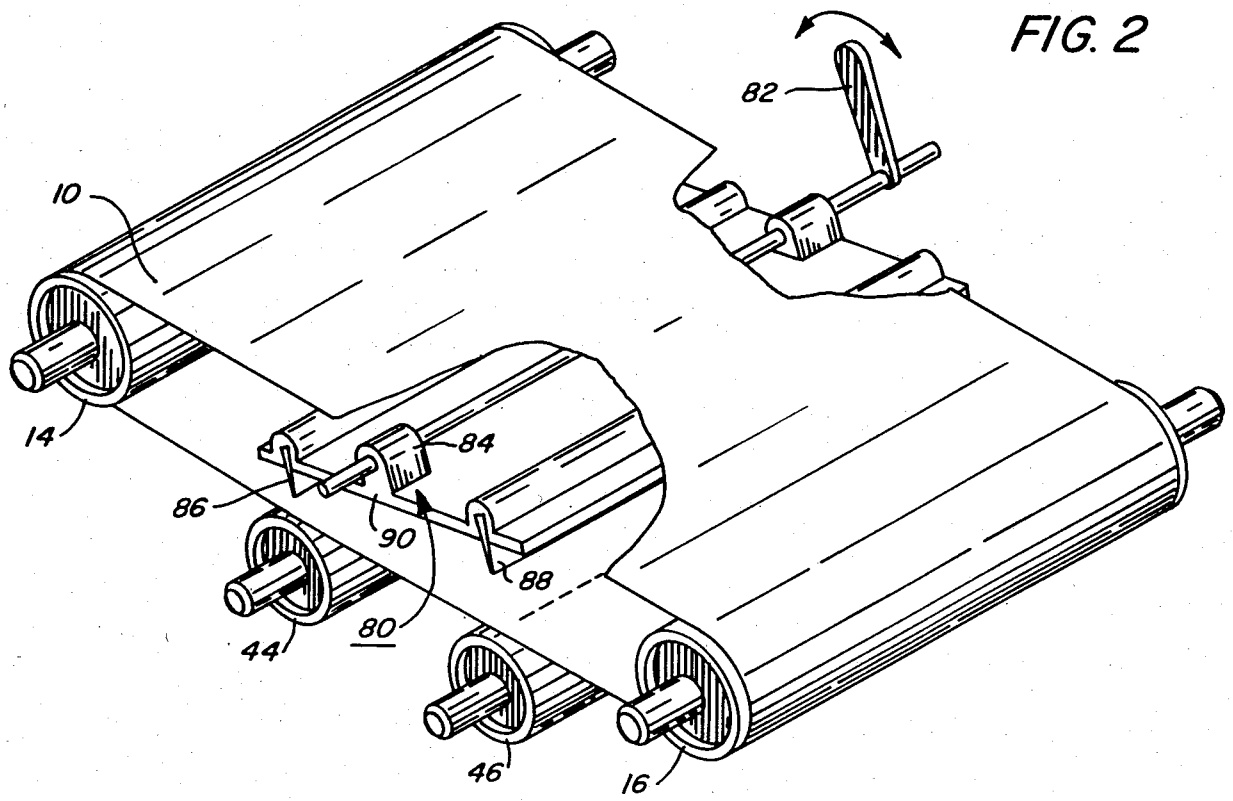
FIG. 2 is an enlarged isometric view of the dual position articulating backup blade used to alternately position the photoreceptor belt into development engagement with one of the more than one developer housings in the developer module.

With additional reference to FIG. 2 the selectable developer or color feature of the present invention will be described in greater detail.

The developer module in the machine is stationarily positioned. The photoreceptor belt which moves past a series of processing stations and is driven about at least two support rolls 14 and 16, is urged into developing engagement with either developer roll 46 or 48 by means of dual positioning articulating backup blade 80, which extends across the interior of the run of the belt between drive roll 14 and idler roll 16 and extends across the width thereof to ensure developing engagement of the belt with one of the rolls. The articulating backup blade arrangement 80 has two blade portions 86 and 88 spaced apart by support 90 which is pivoted at its center about fixed pivot 84 to enable the blade portions to alternately engaged the belt 10. The belt is placed in developing engagement with either developer roll 44 or 46 by means of selecting lever 82 which may be external to the machine so that the operator may manually select which developer to use. This selecting lever or handle 82 is pivotally mounted to be moved between a right and left position about pivot point 84. By actuating the lever 82 the articulating blade arrangement is guided into position to provide developing engagement with either developer roll 44 or 46 by means of blade 86 forcing the belt 10 into engagement with developer roll 44 or blade 88 forcing the belt into engagement with developer roll 46. Alternatively instead of the position of the articulating backup blade being determined by a manual lever, the copying device could be provided with a selectable button wherein a motor would drive the blade from position to position.

Accordingly with the selectable feature of the present invention, the two-developer housings illustrated may be provided with different color developer liquids and depending on the actuation of the dual positioning articulate backup blade the electrostatic latent image on the photoconductive belt may be developed with either of the two colors merely by the simple positioning of a lever or by pushing a button on the copier control console. For example, the developer housing 40 could be equipped with a black developer liquid, while developer housing 42 could be equipped with a red developer liquid. This enables the operator to be able to select the color of the copy reproduced. It also enables the operator to obtain highlight color by initially copying on paper that portion which is to be highlighted, such as a company logo on stationary which may be placed on the platen and thereafter copying the body of the document which may be in ordinary type or print in the normal black color.

It may therefore be readily appreciated by reference to the foregoing description when taken with the drawings that the invention provides a selectable developer capability and in particular, a selectable color developer capability for use in electrostatic reproducing apparatus wherein a photoreceptor belt supported between two support rolls may be alternately urged into development engagement with one of at least two stationary developer housings positioned within a developer module adjacent a run of a photoreceptor belt between the belt support rolls. It further enables the manual selection of developing capabilities by means of a dual positioning articulating backup blade in the interior of the run of the belt which may be manually articulated through a control handle external of the printing machine. This device has the advantage of being compact, low in cost, simple in operation and highly reliable in providing selectable color capability to an electrostatographic reproducing device.

The disclosures of the patents referred to herein are hereby specifically and totally encorporated herein by reference.

While the invention has been described with reference to specific embodiments thereof, it will be apparent to those skilled in the art that many alternatives, modifications and variations may be made. For example, while the invention has been described and illustrated with respect to a two-cycle imaging sequence it will be understood that the selectable color feature may be incorporated in a machine which positions all processing stations around a single cycle of the belt path. Furthermore as indicated previously, a dry development system together with a fuser may be used in place of the liquid development system described herein. Finally while illustrated with reference to a copying device, it will be understood that selectable color features of the present invention may be used in any system that forms electrostatic latent images on a photoconductive belt. Accordingly it is intended to embrace such alternatives and modifications as may fall within the spirit and scope of the appended claims.

What is claimed is:

1. Printing apparatus comprising a flexible photoreceptor belt movable past a series of image processing stations, said belt being driven around at least two support rollers, means to form an electrostatic latent image on said belt, means to develop said electrostatic latent image with a marking material comprising a developer module having at least two alternately selectable stationary developer housings positioned within a run of the photoreceptor belt between said support rolls, means to alternately urge said photoreceptor belt into development engagement with one of said stationary developer housings to develop said electrostatic latent image said urging means comprising a dual position articulating backup blade in the interior of the run of said belt, the two ends of which are alternately engageable with the belt to provide developing engagement with one of said developer housings, and means to transfer said developed image to a receiving surface.

2. The printing apparatus of claim 1 including means to alternately manually articulate said dual position articulating backup blade between positions to provide development engagement of the belt with one of said developer housings.

3. The printing apparatus of claim 1 wherein said developer module comprises two separate developer housings with different color developer material.

4. The printing apparatus of claim 1 wherein each developer housing apparatus comprises a rotatable developer applicator roll for supplying developer to the electrostatic latent image when in development engagement with said belt.

5. The printing apparatus of claim 1 wherein the developer module further includes means to clean the photoreceptor belt in advance of the first developer housing in the developer module.

6. The printing apparatus of claim 1 wherein said means to form an electrostatic latent image comprises means to uniformly charge the photoreceptor belt and means to expose said charged photoreceptor belt to a light and shadow image to be reproduced.

* * * * *